US008678728B1

(12) United States Patent
Ammann

(10) Patent No.: US 8,678,728 B1
(45) Date of Patent: Mar. 25, 2014

(54) VEHICLE LOAD SECURING APPARATUS

(76) Inventor: Myles Ammann, Wilmot, SD (US)

( * ) Notice: Subject to any disclaimer, the term of this patent is extended or adjusted under 35 U.S.C. 154(b) by 86 days.

(21) Appl. No.: 13/447,966

(22) Filed: Apr. 16, 2012

(51) Int. Cl.
*B61D 45/00* (2006.01)

(52) U.S. Cl.
USPC ..... 410/96

(58) Field of Classification Search
USPC ..... 410/96, 104
See application file for complete search history.

(56) References Cited

U.S. PATENT DOCUMENTS 4,842,458 A 6/1989 Carpenter
5,282,706 A 2/1994 Anthony
5,941,666 A 8/1999 Waters
5,961,263 A 10/1999 Nunez
6,059,499 A 5/2000 Bird
6,626,621 B1 9/2003 Hugg
7,334,972 B2 2/2008 Cash

*Primary Examiner* — H Gutman
(74) *Attorney, Agent, or Firm* — Jeffrey A. Proehl; Woods, Fuller, Shultz & Smith, P.C.

(57) ABSTRACT

A vehicle load securing apparatus for securing a load to a vehicle, and including a housing substantially enclosing an interior and having a dispensing opening into the interior, and a spool rotatably mounted in the interior of the housing and including a rotating shaft. The apparatus may further include a length of an elongate member at least partially wrapped about the spool, and a ratcheting structure configured to control rotation of the spool, with the ratcheting structure having an engaged position in which the ratcheting structure resists rotation of the spool in an unwind direction of the spool and a disengaged position in which the ratcheting structure permits rotation of the spool in the unwind direction and a wind direction. The apparatus may also comprise a mounting structure on the housing that is configured to removably mount the housing on the vehicle.

19 Claims, 8 Drawing Sheets

VEHICLE LOAD SECURING APPARATUS

BACKGROUND

Field

The present disclosure relates to load securing devices and more particularly pertains to a new vehicle load securing apparatus that is easily mountable to a vehicle for load securement and conveniently storable when not being used.

SUMMARY

In one aspect, the present disclosure relates to a vehicle load securing apparatus for mounting on a vehicle to secure a load to a load bed of the vehicle. The apparatus may comprise a housing substantially enclosing an interior with a dispensing opening into the interior, a spool rotatably mounted in the interior of the housing and including a rotating shaft, and a length of an elongate member at least partially wrapped about the spool, a secured end of the elongate member being secured to the spool and a hook being mounted on a free end of the elongate member. The apparatus may also include a ratcheting structure configured to control rotation of the spool, the ratcheting structure having an engaged position in which the ratcheting structure resists rotation of the spool in an unwind direction of the spool and a disengaged position in which the ratcheting structure permits rotation of the spool in the unwind direction and a wind direction. The apparatus may further include a mounting structure on the housing and configured to removably mount the housing on the vehicle.

In another aspect, the present disclosure relates to a vehicle load securing apparatus for mounting on a vehicle to secure a load to a load bed of the vehicle. The apparatus may comprise a housing substantially enclosing an interior with a dispensing opening into the interior, a spool rotatably mounted in the interior of the housing and including a rotating shaft, and a length of an elongate member at least partially wrapped about the spool, a secured end of the elongate member being secured to the spool and a hook being mounted on a free end of the elongate member. The apparatus may also include a ratcheting structure configured to control rotation of the spool, the ratcheting structure having an engaged position in which the ratcheting structure resists rotation of the spool in an unwind direction of the spool and a disengaged position in which the ratcheting structure permits rotation of the spool in the unwind direction and a wind direction. The apparatus may further include a mounting structure on the housing and configured to removably mount the housing on the vehicle, and the mounting structure may comprise a rail mounting member defining a slot for receiving a portion of the mounting rail, and the slot may be substantially T-shaped to receive a substantially T-shaped portion of the mounting rail.

In yet another aspect, the present disclosure relates to a vehicle load securing apparatus for mounting on a vehicle to secure a load to a load bed of the vehicle. The apparatus may comprise a housing substantially enclosing an interior with a dispensing opening into the interior, a spool rotatably mounted in the interior of the housing and including a rotating shaft, and a length of an elongate member at least partially wrapped about the spool, a secured end of the elongate member being secured to the spool and a hook being mounted on a free end of the elongate member. The apparatus may also include a ratcheting structure configured to control rotation of the spool, the ratcheting structure having an engaged position in which the ratcheting structure resists rotation of the spool in an unwind direction of the spool and a disengaged position in which the ratcheting structure permits rotation of the spool in the unwind direction and a wind direction. The apparatus may further include a mounting structure on the housing and configured to removably mount the housing on the vehicle. The mounting structure may comprise a mount hook removably mounted on the housing and an abutment member on the housing positioned opposite of an opening of the mount hook to receive a portion of a mounting channel on the vehicle when the hook is mounted on the housing.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
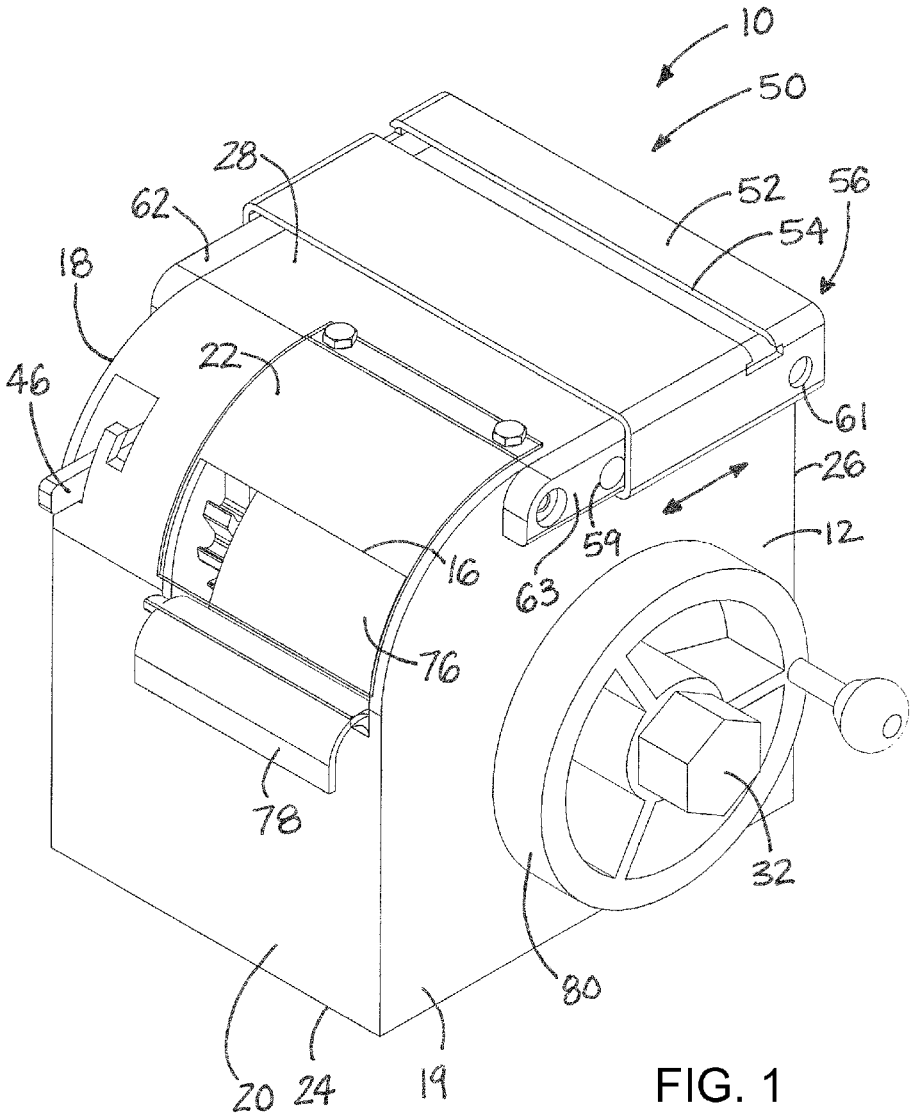
FIG. 1 is a schematic perspective view of a new vehicle load securing apparatus according to the present disclosure.
Figure 2:
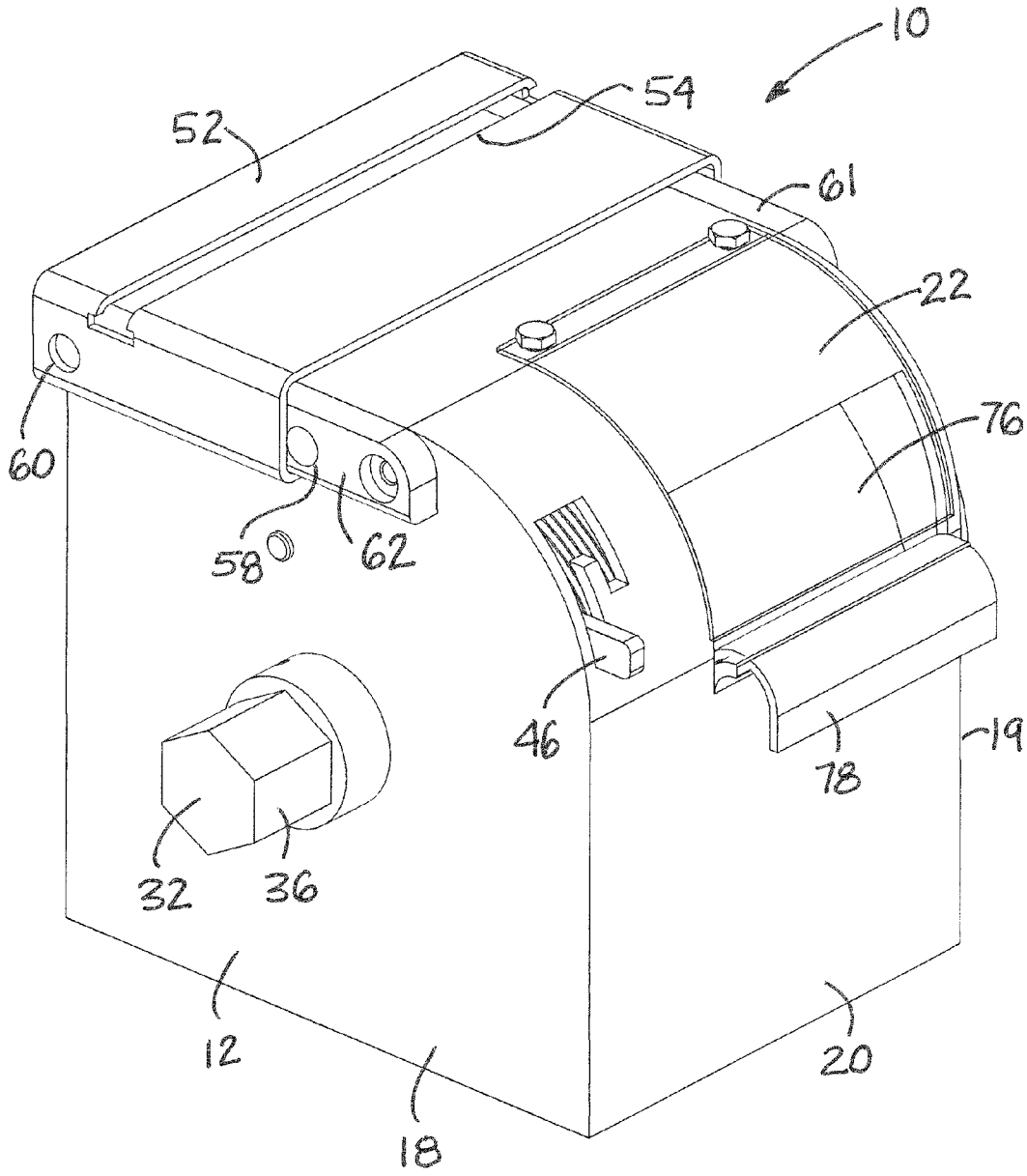
FIG. 2 is a schematic perspective view of the embodiment shown in FIG. 1.
Figure 3:
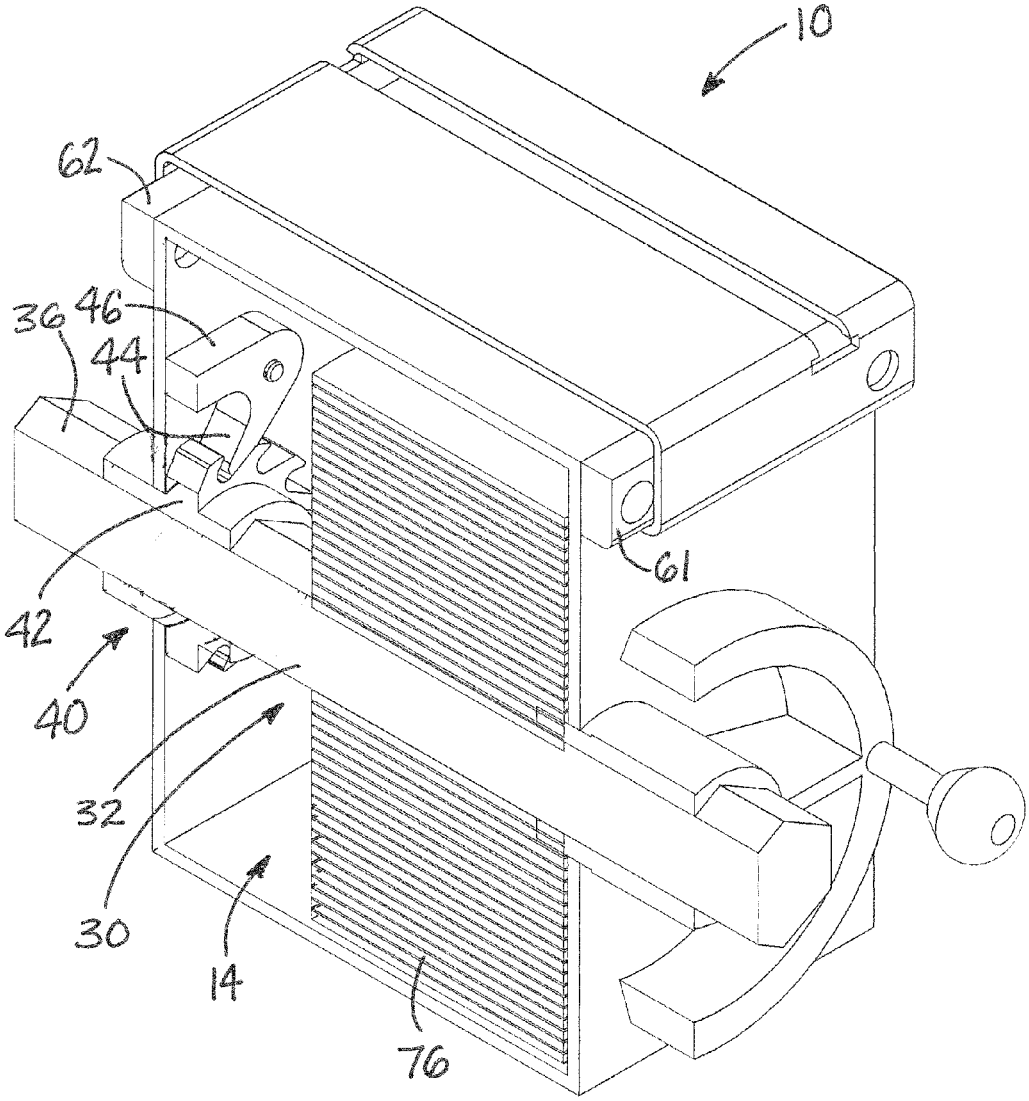
FIG. 3 is a schematic perspective sectional view of the embodiment shown in FIG. 1.
Figure 4:
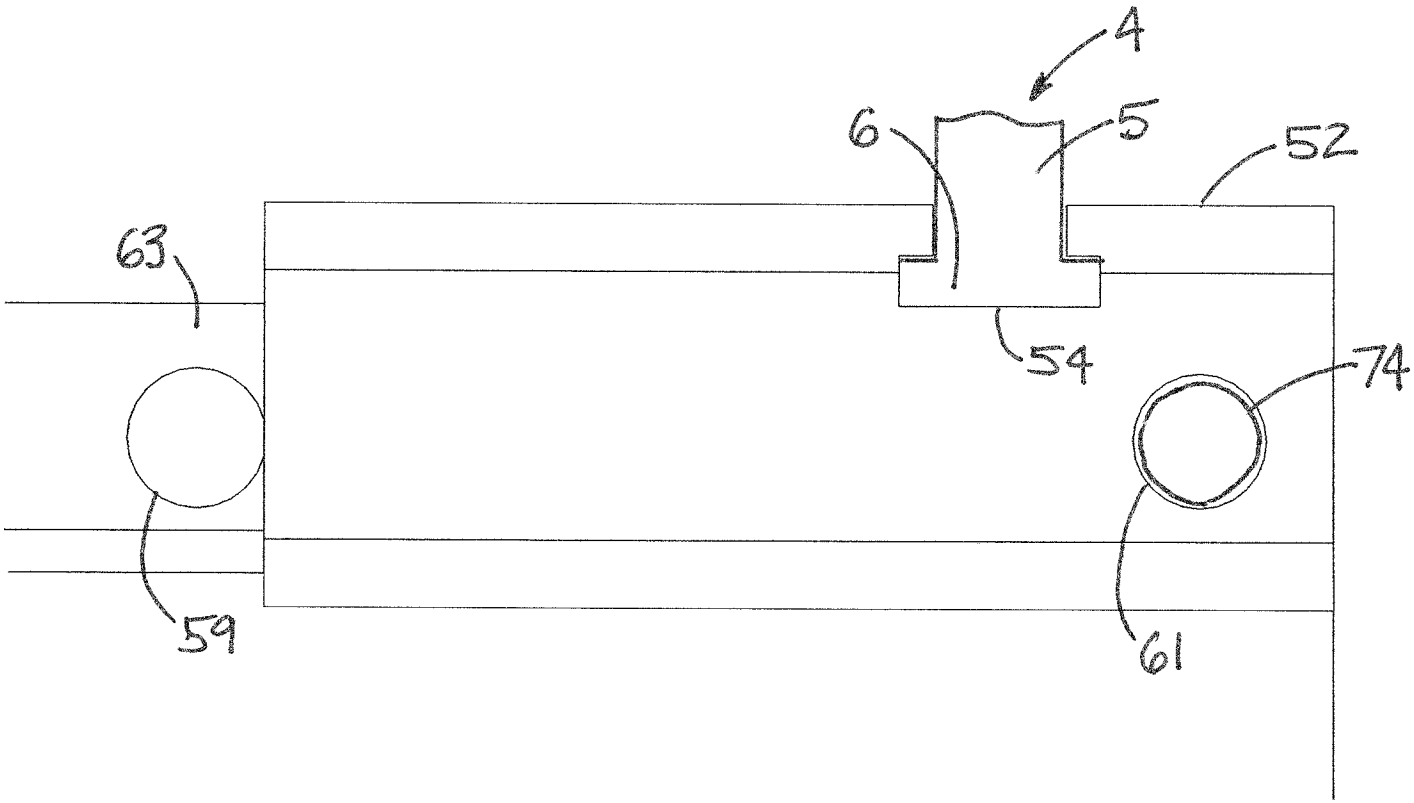
FIG. 4 is a schematic side view of the portion of the embodiment of FIG. 1 showing aspects of the mounting structure.
Figure 5:
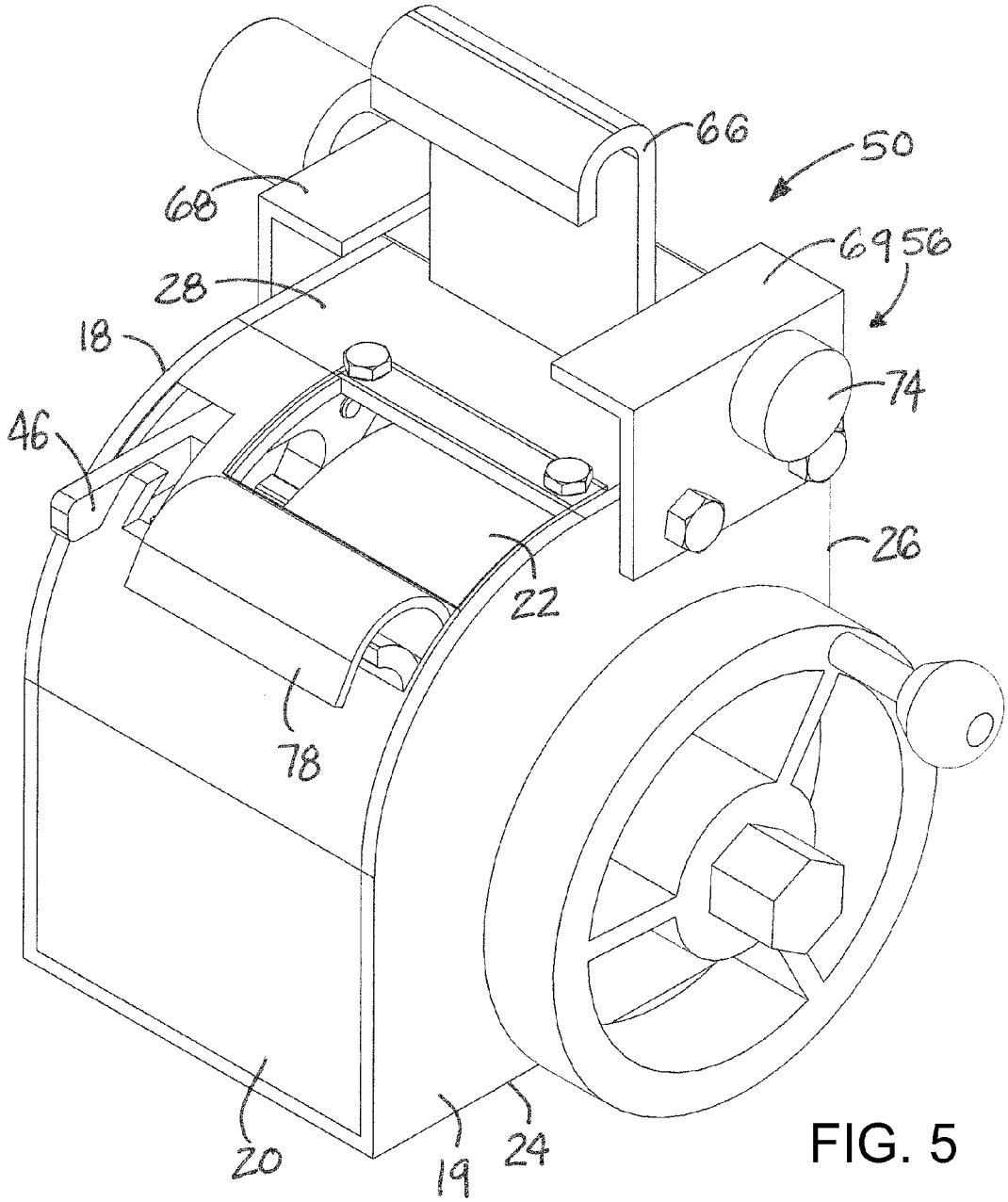
FIG. 5 is a schematic perspective view of another illustrative embodiment of the apparatus of the disclosure.
Figure 6:
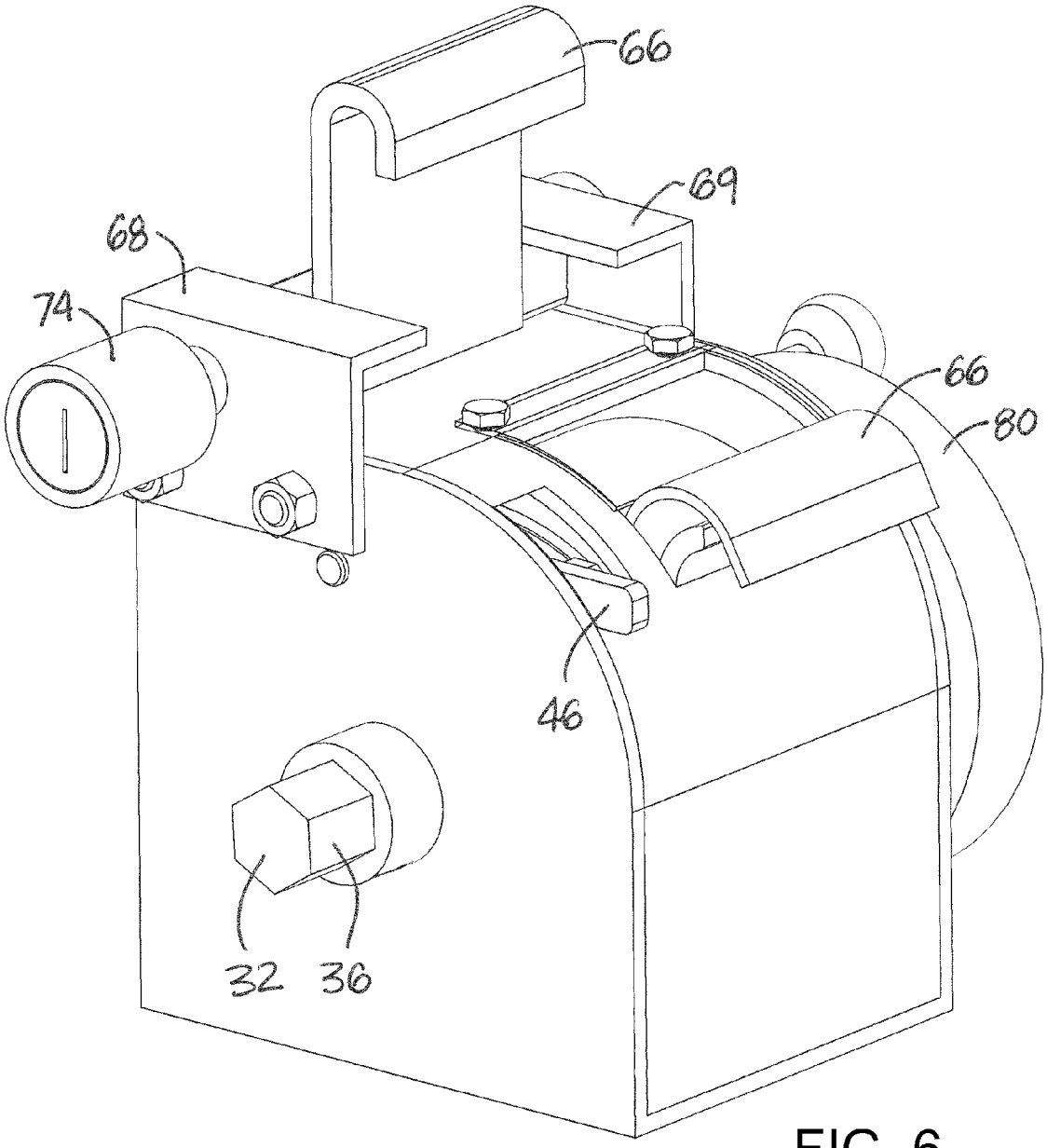
FIG. 6 is a schematic perspective view of the embodiment shown in FIG. 5.
Figure 7:
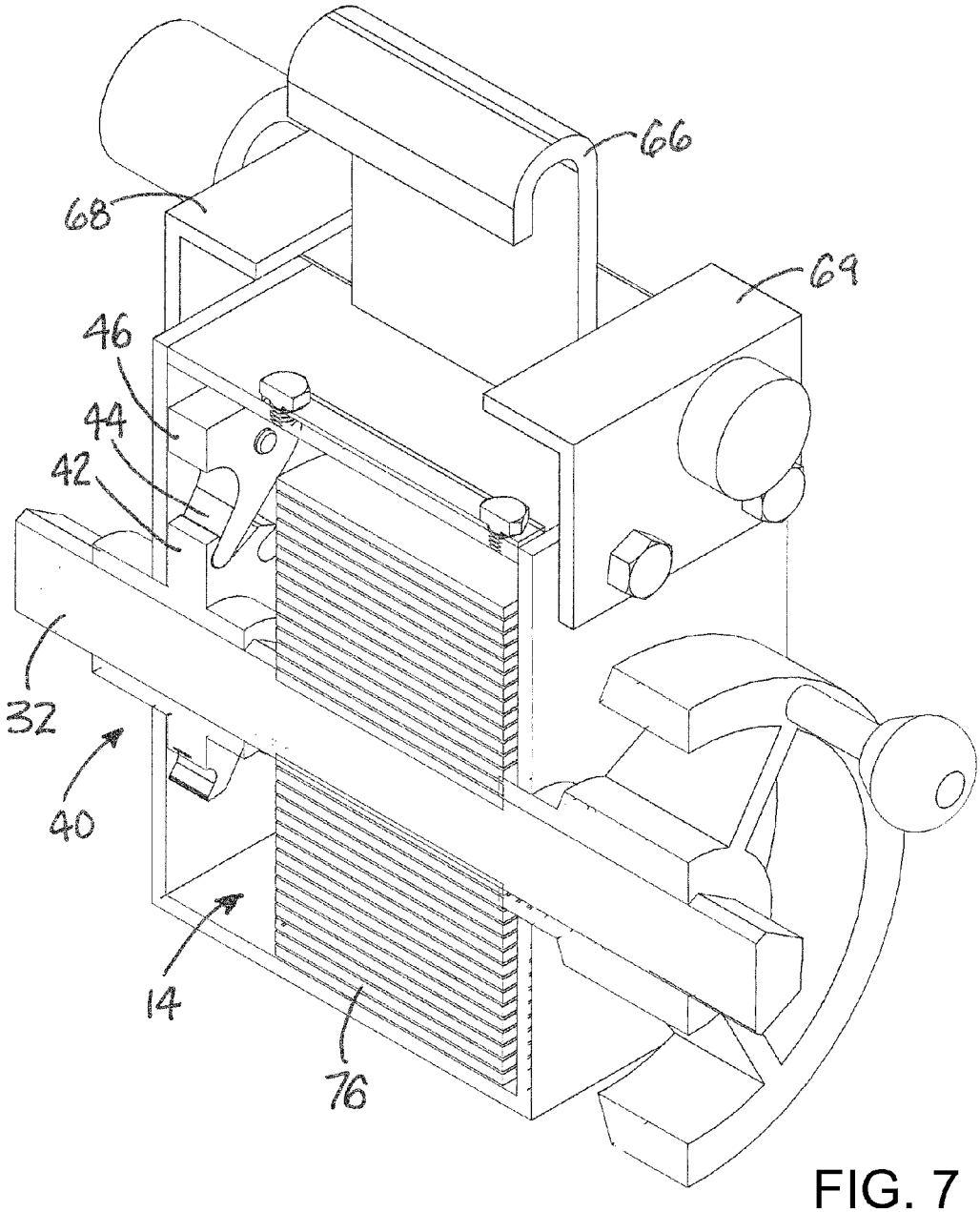
FIG. 7 is a schematic perspective sectional view of the embodiment shown in FIG. 5.
Figure 8:
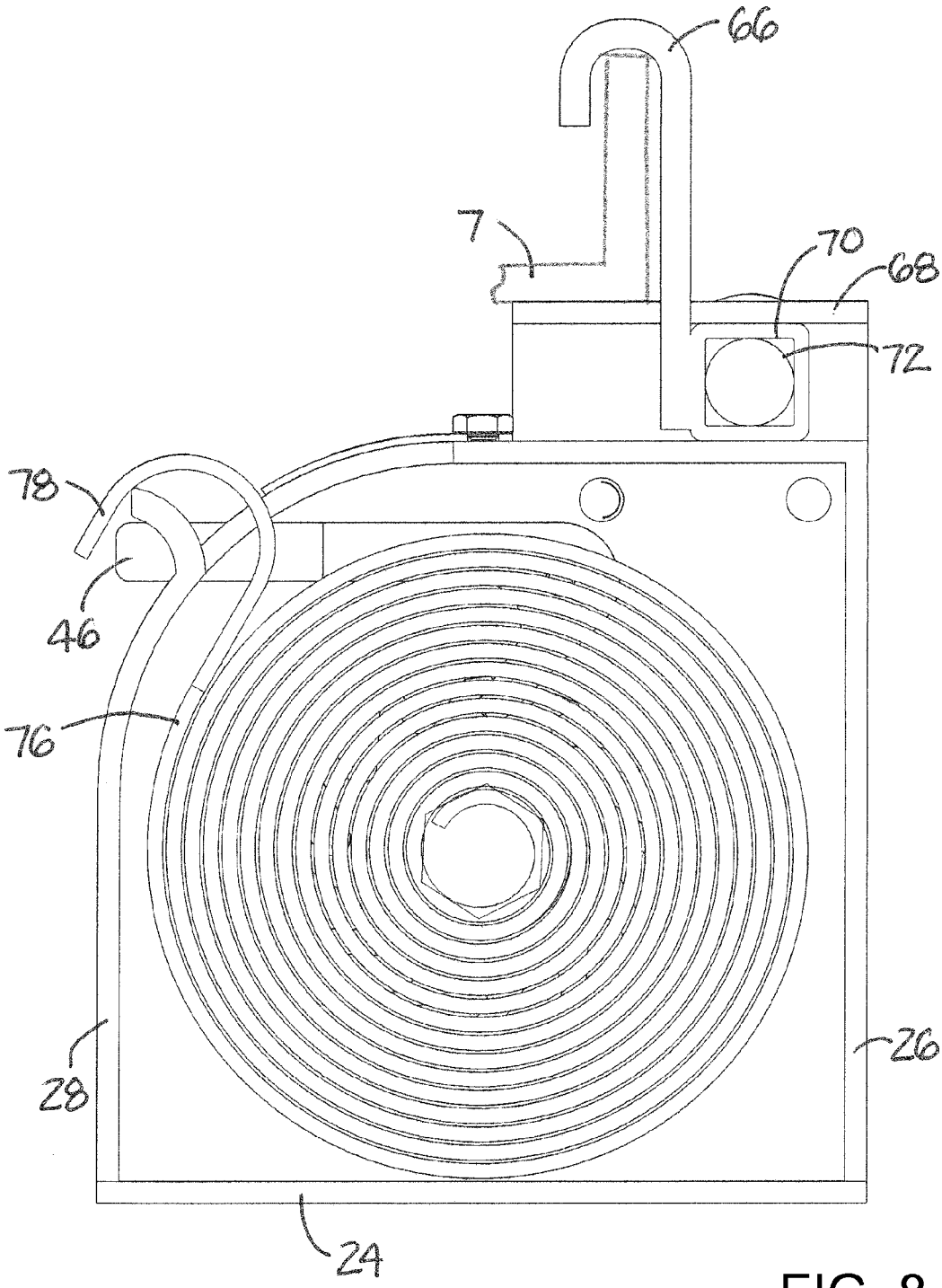
FIG. 8 is a schematic side sectional view of the embodiment shown in FIG. 5.

With reference now to the drawings, and in particular to FIGS. 1 through 8 thereof, a new vehicle load securing apparatus embodying the principles and concepts of the disclosed subject matter will be described.

In some aspects, the disclosure relates to a vehicle load securing apparatus for mounting on a vehicle 1 to help secure the load to the vehicle. The apparatus 10 is highly suitable, for example, to secure a load to a load bed of a vehicle. For the purposes of this disclosure, the vehicle may be a mobile base with or without an engine, such as, for example, a pickup, pickup trailer or semi-trailer. In many applications, the load bed may include a mounting rail 4 extending along at least a portion of the perimeter of the load bed, and in some cases the mounting rail may be mounted on the underside of the load bed, although this is not critical. An illustrative mounting rail may include a web portion 5 and a flange portion 6 with the flange portion being oriented substantially perpendicular to the web portion in a generally T-shaped configuration. In other applications, the apparatus may be used with other structures of the vehicle, such as, for example, a channel 7 extending along a perimeter of the load bed.

The load securing apparatus 10 may include a housing 12 for mounting on the load bed 3 or a mounting element of the load bed such as the aforementioned mounting rail and like. The housing 12 may substantially enclose an interior 14. The housing 12 may also have a dispensing opening 16 that extends from an exterior of the housing into the interior 14. In the illustrative embodiments, the housing 12 includes opposite side walls 18, 19 and a perimeter wall 20 that extends between the side walls. The dispensing opening 16 may be located in the perimeter wall, and in some embodiments a rounded surface may be provided adjacent to the opening to provide a highly suitable surface for the elongate member 76 to rub and reduce friction and the resulting wear. Optionally, a fastener such as a bolt may be extended between the side walls 18, 19 and positioned adjacent to the opening 16 to provide the rounded surface.

A protective flap 22 may extend over the dispensing opening to help deflect moisture and dirt from entering the dispensing opening while still permitting free movement through the opening by the elongate member 76. The protective flap 22 may be formed of a material that is sufficiently flexible to permit deflection from a position over the dispensing opening when the elongate member 76 is being moved through the opening, but should exhibit sufficiently resiliency so that the flap returns to the position over the opening when the movement ceases. In some embodiments, the perimeter wall 20 may include a base wall portion 24, a back wall portion 26, and an upper wall portion 28, with the dispensing opening 16 being located in the upper wall portion of the perimeter wall. Optionally, the flap 22 may be omitted, such as in embodiments in which the dispensing opening is sufficiently constricted in size to limit debris and moisture entry in to the opening.

A spool 30 may be rotatably mounted in the interior 14 of the housing 12 and may include a rotating shaft 32. The rotating shaft 32 may have an end portion 36 that extends through the housing, and the end portion may be configured to being engaged by a rotation tool 38, such as by forming the end portion with a square or hexagonal cross sectional shape. The rotation tool may facilitate manual rotation of the spool, and may be the rotation tool being removably mountable on the end portion 36 of the rotating shaft. In some embodiments, the spool 30 may further include side flanges mounted on the rotating shaft and spaced so that the flexible member is positioned between the flanges when the member is wound about the shaft.

The apparatus 10 may also include a ratcheting structure 40 that is configured to control rotation of the spool 30 with respect to the housing, and thus may be mounted on an element of the spool and on the housing. Illustratively, the ratcheting structure 40 may include a ratchet wheel 42 with teeth formed thereon that is connected to the spool 30 and a pawl 44 that is engagable with the ratchet wheel. The pawl 44 may be movable, and may be movable between an engaged position that is characterized by the pawl resisting rotation of the spool in an unwind direction of the spool, and a disengaged position that is characterized by the pawl permitting rotation of the spool in the unwind direction and a wind direction. The ratcheting structure 40 may be positioned in the interior of the housing, although exterior positioning may also be utilized. The ratcheting structure 40 may also include a release lever 46 that is configured to move the pawl 44 between the engaged position and the disengaged position as the lever is moved.

A significant feature of the load securing apparatus 10 is a mounting structure 50 that may be configured to mount the housing 12 on the vehicle 1, such as on the mounting rail 4 or the perimeter channel 7 of the vehicle. The mounting structure 50 may be located on the housing 12. The mounting structure may include different elements and configurations for mounting on different structures on the vehicle.

For example, as shown in FIGS. 1 through 4, for mounting the housing 12 to a vehicle having a mounting rail 4, the mounting structure 50 may comprise a rail mounting member 52 for receiving a portion of the mounting rail 4. The rail mounting member 52 may define a slot 54 which may be configured to receive a portion of the mounting rail 4 so that the mounting structure, and the housing, may be slidable along the rail to adjust a position of the apparatus 10 on the vehicle. In applications where the mounting rail has a T-shape, the slot 54 may be configured to receive the flange portion 60 and a section of the web portion 5. The rail mounting member 52 may be movably positionable on the housing 12 to adjust a position of the slot 54 with respect to the housing to adjust an offset of the housing. The rail mounting member 52 may be releasably lockable in at least two positions on the housing to adjust the offset. The mounting structure 50 may comprise a locking structure 56 for locking the rail mounting member 52 in at least two different positions on the housing 12. The locking structure 56 may include at least a pair of apertures 58, 59 in the housing and a pair of holes 60, 61 in the rail mounting member 52, with a first one 58 of the apertures and a first one 60 of the holes being alignable in a first position of the rail mounting member on the housing, and a second one 59 of the apertures and a second one 61 of the holes being alignable in a second position of the rail mounting structure on the housing. A post member 74 may be inserted through the aligned voids to lock the position of the rail mounting member. The mounting structure 50 may include at least one guide 62 on which the rail mounting member 52 is mounted, and the mounting structure may include a second guide 63. The rail mounting member 52 may be slidable on the guide or guides between the two or more positions. In use, the mounting rail may be inserted into the slot in the rail mounting member and the housing may be slid along the rail to the desired position, and the position of the rail mounting member on the housing may be adjusted to provide the needed offset from the rail.

As another example, as shown in FIGS. 5 through 8, for mounting the housing to a vehicle having a perimeter channel 7, the mounting structure 50 may comprise a mount hook 66 removably mounted on the housing and an abutment member 68 on the housing, and these two elements may removably secure a portion of the vehicle, such as the perimeter channel, between the mount hook and the abutment member to mount the housing on the vehicle. The mount hook 66 may have a passage 70 formed therein and the abutment member may have a hole 72, and a post member 74 may be insertable into the passage 70 of the mount hook and the hole 72 in the abutment member to secure the mount hook to the abutment member such that the mount hook is removably mounted on the abutment member on the housing. In some embodiments, a pair of the abutment members 68, 69 may be mounted on the housing, and may be positioned on opposite sides of the housing 12 such that the mount hook 66 may be positioned between the abutment members. In use, the mount hook may be hooked on one of the legs of the channel 7 and the passage of the mount hook aligned with the holes in the abutment members so that the leg of the channel is positioned between the mount hook and the abutment members, and then the post member 74 may be inserted through the holes and the passage to hold the mount hook in position with respect to the abutment member. The trapping of the channel leg between the mount hook and the abutment member holds the housing to the vehicle.

The apparatus 10 may also include a length of an elongate member 76 that is at least partially wrapped about the spool 30 and positioned in the interior of the housing. The elongate member 76 is preferably flexible in character to extend and conform to some degree to the shape of the load over which may be extended. A hook 78 may be mounted on a free end of the elongate member, and the opposite end of the elongate member may be mounted or secured to the spool. The hook 78 is preferably adapted to be hooked onto a structure on the vehicle when the elongate member is withdrawn from the housing to a suitable length, such as a location on an opposite side of the load bed. In some of the most preferred embodiments, the elongate member 76 comprises an elongate strap or band of material. The strap may be wound about the spool by rotating the spool in the wind direction, and unwound from the spool by rotating the spool in the unwind direction, or by simply pulling the hook end of the strap from the housing through the dispensing opening. The strap is unwound to approximately the suitable length to extend at least partially about the load, the hook is secured to another location on the vehicle on the opposite side of the load, and the strap may be drawn tight by rotating the spool in the wind direction to drawn a portion of the strap back into the housing, with the ratcheting structure holding the strap in the housing.

Optionally, a wheel 80 may be provided to control rotation of the spool, and may be mounted on or connected to the rotating shaft 32 of the spool. The wheel may be connected to the end portion 36 of the shaft to rotate with the shaft, and the wheel may be positioned outside of the housing, It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A vehicle load securing apparatus for mounting on a vehicle to secure a load to a load bed of the vehicle, the apparatus comprising:

a housing substantially enclosing an interior, the housing having a dispensing opening into the interior;

a spool rotatably mounted in the interior of the housing and including a rotating shaft;

a length of an elongate member at least partially wrapped about the spool, a secured end of the elongate member being secured to the spool and a hook being mounted on a free end of the elongate member;

a ratcheting structure configured to control rotation of the spool, the ratcheting structure having an engaged position in which the ratcheting structure resists rotation of the spool in an unwind direction of the spool and a disengaged position in which the ratcheting structure permits rotation of the spool in the unwind direction and a wind direction; and a mounting structure on the housing and configured to removably mount the housing on the vehicle;

wherein the ratcheting structure is manipulatable from an exterior of the housing to change the ratcheting structure between the engaged position and the disengaged position.

2. The apparatus of claim 1 wherein the load bed includes a mounting rail; and wherein the mounting structure comprises a rail mounting member for receiving a portion of the mounting rail, the rail mounting member defining a slot configured to receive a portion of the mounting rail.

3. The apparatus of claim 2 wherein the rail mounting member is movably positionable on the housing and releasably lockable in at least two positions on the housing to adjust a mounted position of the housing on the rail.

4. The apparatus of claim 3 wherein the mounting structure includes a locking structure for locking the rail mounting member in at least two different positions on the housing.

5. The apparatus of claim 2 wherein the slot has a substantially T-shaped configuration.

6. The apparatus of claim 5 wherein the mount hook has a passage formed therein and the abutment member having a hole, a post member being insertable into the passage of the mount hook and the hole of the abutment member to removably mount the mount hook to the abutment member.

7. The apparatus of claim 1 wherein the load bed includes a perimeter channel; and wherein the mounting structure comprises a mount hook removably mounted on the housing and an abutment member on the housing for removably securing a portion of the channel between the mount hook and the abutment member to mount the housing on the vehicle.

8. The apparatus of claim 1 additionally comprising a hand-operable wheel configured to control rotation of the spool, the wheel being connected to the rotating shaft and being positioned outside of the housing, the wheel including a rim for gripping by a hand, a hub mounted on the shaft, and a plurality of spokes connecting the rim to the hub.

9. The apparatus of claim 1 wherein the rotating shaft has a portion protruding out of the interior of the housing, the protruding portion having a hexagonal cross sectional shape.

10. The apparatus of claim 9 additionally comprising a rotation tool configured to facilitate manual rotation of the spool, the rotation tool having a hexagonal opening configured to receive the protruding portion of the rotating shaft such that the tool is removably mountable on the end portion of the rotating shaft of the spool.

11. The apparatus of claim 1 wherein the elongate member comprises an elongate strap.

12. The apparatus of claim 1 wherein the ratcheting structure includes a ratchet wheel connected to the spool and a pawl engagable with the ratchet wheel.

13. The apparatus of claim 12 wherein the ratcheting structure includes a release lever configured to move the pawl between an engaged position and a disengaged position, the release lever extending out of the interior of the housing such that the lever is manipulatable from the exterior of the housing.

14. The apparatus of claim 1 wherein the housing is formed by a plurality of walls defining the interior of the housing, the walls being connected together as a unit.

15. The apparatus of claim 1 wherein a portion of the rotating shaft protrudes out of the interior of the housing, a hand wheel being mounted on the protruding portion of the rotating shaft to rotate with the shaft, a section of the protruding portion having a hexagonal cross sectional shape engagable by a rotating tool.

16. A vehicle load securing apparatus for mounting on a vehicle to secure a load to a load bed of the vehicle, the apparatus comprising:

a housing substantially enclosing an interior, the housing having a dispensing opening into the interior;

a spool rotatably mounted in the interior of the housing and including a rotating shaft;

a length of an elongate member at least partially wrapped about the spool, a secured end of the elongate member being secured to the spool and a hook being mounted on a free end of the elongate member;

a ratcheting structure configured to control rotation of the spool, the ratcheting structure having an engaged position in which the ratcheting structure resists rotation of the spool in an unwind direction of the spool and a disengaged position in which the ratcheting structure permits rotation of the spool in the unwind direction and a wind direction; and a mounting structure on the housing and configured to removably mount the housing on a mounting rail of the vehicle, the mounting structure comprising a rail mounting member defining a slot for receiving a portion of the mounting rail, the slot being substantially T-shaped to receive a substantially T-shaped portion of the mounting rail.

17. The apparatus of claim 16 wherein the rail mounting member is movably positionable on the housing and releasably lockable in at least two positions on the housing to adjust a mounted position of the housing on the rail.

18. The apparatus of claim 16 wherein the ratcheting structure is manipulatable from an exterior of the housing without opening the housing in order to change the ratcheting structure between the engaged position and the disengaged position.

19. A vehicle load securing apparatus for mounting on a vehicle to secure a load to a load bed of the vehicle, the apparatus comprising:

a housing including a plurality of walls substantially enclosing an interior of the housing, the walls being connected together as a unit and having a dispensing opening into the interior;

a spool rotatably mounted in the interior of the housing and including a rotating shaft;

a wheel mounted on the rotating shaft to rotate with the spool and shaft, the wheel being positioned outside of the interior of the housing on the shaft to permit manual rotation of the spool from the exterior of the housing;

a length of an elongate member at least partially wrapped about the spool, a secured end of the elongate member being secured to the spool and a hook being mounted on a free end of the elongate member;

a ratcheting structure in the housing interior and configured to control rotation of the spool, the ratcheting structure having an engaged position in which the ratcheting structure resists rotation of the spool in an unwind direction of the spool and a disengaged position in which the ratcheting structure permits rotation of the spool in the unwind direction and a wind direction; and a mounting structure on the housing and configured to removably mount the housing on the vehicle;

wherein the ratcheting structure includes a release lever manipulatable from an exterior of the housing to change the ratcheting structure between the engaged position and the disengaged position without opening the housing.

* * * * *